US008127866B2

(12) United States Patent
Anthony

(10) Patent No.: US 8,127,866 B2
(45) **Date of Patent: *Mar. 6, 2012**

(54) AIR INJECTION COLLAR

(76) Inventor: Paul G. Anthony, Bakersfield, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/421,799

(22) Filed: Apr. 10, 2009

(65) Prior Publication Data

US 2009/0205872 A1 Aug. 20, 2009

Related U.S. Application Data

(63) Continuation of application No. 11/351,711, filed on Feb. 10, 2006, now Pat. No. 7,516,803.

(60) Provisional application No. 60/652,385, filed on Feb. 11, 2005.

(51) Int. Cl.
*E21B 21/12* (2006.01)

(52) U.S. Cl. ..... 175/205; 175/69; 175/72

(58) Field of Classification Search ..... 175/205, 175/69, 72, 206

See application file for complete search history.

(56) References Cited

U.S. PATENT DOCUMENTS

| | | | | |
|---|---|---|---|---|
| 1,346,939 | A | 7/1920 | Carmichael | |
| 2,726,063 | A * | 12/1955 | Ragland et al. | 175/69 |
| 3,077,358 | A | 2/1963 | Costa | |
| 3,497,020 | A | 2/1970 | Kammerer, Jr. | |
| 3,534,822 | A | 10/1970 | Campbell | |
| 3,827,511 | A | 8/1974 | Jones | |
| 5,140,759 | A * | 8/1992 | Artzberger | 37/347 |
| 5,509,442 | A | 4/1996 | Claycomb | |
| 5,873,420 | A | 2/1999 | Gearhart | |
| 6,378,633 | B1 | 4/2002 | Moore et al. | |
| 7,516,703 | B2 * | 4/2009 | Tazreiter | 105/443 |
| 2005/0098355 | A1 | 5/2005 | Broom | |

* cited by examiner

*Primary Examiner* — Brad Harcourt
(74) *Attorney, Agent, or Firm* — Mark D. Miller; Marcus N. DiBuduo

(57) ABSTRACT

The present invention is an air injection collar for use in the drilling industry that is used to reduce the weight of the column of returning drilling mud and debris without causing unnecessary frictional wear on the drill pipe. The invention is a unique sleeve that is coupled to a drill casing that includes an input port for receiving the pressurized air or other fluid from the surface, an annular plenum extending around the drill casing, and a series of openings in the plenum leading to the inside of the drill casing. These openings disperse the pressurized air or other fluid into the upflowing mud around the central drill pipe so that it is not concentrated in one place, especially the center of the casing, where it could cause frictional damage to the drill pipe.

26 Claims, 5 Drawing Sheets

AIR INJECTION COLLAR

This application is a continuation of U.S. application Ser. No. 11/351,711, filed Feb. 10, 2006, which claims the benefit of U.S. Provisional Application No. 60/652,385 filed on Feb. 11, 2005, each of which is incorporated by this reference.

BACKGROUND OF THE INVENTION

1. Field of the Invention

The present invention is an air or gas injection collar for use in oil and gas drilling operations. In particular, the present invention is directed towards an apparatus in the form of a cylindrical sleeve that is coupled into a drill casing pipe to provide for specialized introduction of air or gas into the drill casing, as well as methods for its installation and use.

2. Description of the Prior Art

Mankind has been drilling for oil and gas for well over a century. Current methods and apparatus for drilling in the ground for oil or gas make use of an open-ended drill bit that is attached to the end of a continuously extended drill pipe. The drill pipe is rotated causing the drill bit to dig down into the earth. Additional lengths of pipe are attached end-to-end as the drill bit continues to dig down, creating a lengthy shaft. The earth, rock, chips and debris that are dislodged by the drill bit are removed by pumping specialized material (often referred to as "mud") down through the drill pipe. This material exits through the open end of the drill bit and returns to the surface around the outside of the drill pipe through the earthen shaft that has been dug by the drill bit, carrying the dislodged material with it. At the surface, the dislodged earth, rock, chips and debris are separated from the mud which is recycled and sent back down through the drill pipe to repeat the process.

In order for the mud to bring the dislodged material to the surface, it is necessary for the sides of the shaft that has been cut into the earth to be of sufficient strength. It is not uncommon for a drill shaft to extend down hundreds if not thousands of feet. The mud that is pumped down through the drill pipe forms an annular column around the pipe as it returns to the surface, forming a tall column of mud and dislodged material. This results in extreme pressures per square inch, particularly at the bottom of the shaft. It is often the case that the layers of rock, sediment or other geologic material through which the shaft has been dug are not sufficiently strong to withstand these pressures, resulting in the mud and debris traveling laterally into the weaker earthen layers, instead of returning to the surface. This is undesirable and wasteful of the very expensive and specialized "mud" that is used. Further, if enough of the specialized mud is lost, the lack of pressure and lubrication in the well can cause further fracturing of the weaker earthen formations and damage to the drill pipe. If portions of the earthen formation fall into the annulus of the drill pipe they can be come firmly lodged, potentially resulting in the loss of both the pipe and the well.

It is common in the drilling industry to insert drill casing along the sides of the shaft once a certain depth is reached. The drill casing is simply a hollow cylindrical wall made up of segments of pipe that are inserted into the earthen shaft. Once the casing is inserted and cemented into place, then drilling can resume, with the drill pipe extending down the center of the casing and beyond into lower geological layers.

The conventional method for dealing with the problem of weak geologic layers is to reduce the weight of the mud that is returning to the surface by adding air to it. This is accomplished by routing an air pipe down the outside of the drill casing, and attaching this pipe to the drill casing at as low (deep) a location as practicable as shown in U.S. Pat. No. 2,726,063. The air pipe connects to an opening on the drill casing which air that is pumped down from the surface is introduced to the inside of the casing. This air is added to the annular column of mud and debris that is rising inside the casing, causing it to have less density, and hence less weight. This reduces the weight of the overall column of mud and debris, reducing the pressure on the mud and debris below the end of the casing where the weaker geologic layers may be found. An alternative method for introducing air is found in U.S. Pat. Nos. 3,497,020 and 3,534,822 which disclose providing an annular column of air inside the drill pipe or casing that is mixed with the returning mud through a series of ports. Both of these inventions require at least one extra cylindrical casing wall and both waste valuable interior casing space to provide the column of air, greatly increasing the cost and diameter of the drilling assembly.

Unfortunately, the introduction of pressurized air can increase frictional erosion inside the casing. A single inlet, or multiple uncontrolled inlets for introducing pressurized air into the drill casing effectively turn the rising mud and debris into a sandblaster that wears against the rotating central drill pipe. The friction caused by the sand and debris that is thrust against the drill pipe by the pressurized air eventually weakens the drill pipe and shortens its useful life. This is undesirable since the drill pipe is otherwise reusable, and must be strong enough to transmit the rotational force from the surface down to the drill bit in order to grind into layers of rock.

Another method for inducting air into the specialized mud is illustrated in U.S. Pat. No. 5,873,420 which discloses an air conducting tube that is provided on the inside of the drill pipe for introducing air to be mixed with mud at the drill bit. This tube runs the entire length of the drill pipe terminating above the bit where a valve, solenoid opener and centering devices are all deployed. However, the location of these devices inside the drill pipe is not only likely to interfere with the smooth flow of mud inside the drill pipe, it also increases the chances of a malfunction (or non function) since the high pressure and movement of the mud may prevent the solenoid from operating properly. In addition, failure of any of these components requires removal of the entire drill pipe for replacement.

It is therefore desirable to provide an apparatus and method for reducing the weight of the returning drilling mud without causing unnecessary frictional wear on the drill pipe, or interfering with normal drilling operations.

SUMMARY OF THE INVENTION

The air injection collar of the present invention reduces the weight of the returning drilling mud without interfering with normal drilling operations or causing unnecessary frictional wear on the drill pipe by providing a unique introduction sleeve for air, gas or other fluid that is coupled to a drill casing. The sleeve of the present invention includes an input opening for receiving pressurized air, gas or other fluid from above, an annular plenum that extends around an outside cylindrical area of the drill casing, and a plurality of openings in the plenum leading to the inside of the drill casing. These openings may be simple notches or cuts on the inside of the annular plenum communicating between the plenum and the interior of the drill casing. The multiple openings disperse the pressurized air, gas or other fluid around the casing so that it is not concentrated in one place where it could cause frictional damage to the interior drill pipe.

Preferably, the multiple openings in the plenum are a series of pairs of angled slots, the slots of each pair having opposing angles of sufficient degree that the two jets of air entering the drill casing through the pair of slots intersect each other at a point that is within the annular column of rising mud, but away from the interior drill pipe. Pointing the angled slots (gas jets) in this way disperses the air into the mud, but avoids increasing frictional wear on the drill pipe. In an alternative embodiment, the slots may all face in the same direction, creating a helical vortex which may be appropriate for some applications, but not appropriate for others. In other embodiments, the openings may be provided in regular or random patterns to provide different levels of aeration of the rising mud. It is to be appreciated that the plurality of openings between the plenum and the interior of the drill casing may be of any appropriate size, shape, orientation and/or angle to produce aeration while reducing frictional wear on the interior drill pipe.

In one embodiment, the air inlet is offset from the location of the openings in the plenum to avoid direct transmission of pressure through the openings closest to the inlet. Pressurized air enters the plenum from the inlet and then is dispersed through each of the plurality of openings at nearly the same pressure to prevent the possibility of stronger jets of air causing damage to the central drill pipe.

It is therefore an object of the present invention to provide an apparatus and methods for introducing air, gases or other fluids to be mixed with mud and debris flowing upward inside a drill casing that prevents frictional damage to the drill pipe inside the casing.

It is also an object of the present invention to provide an apparatus and methods for introducing air, gases or other fluids to be mixed with mud and debris flowing upward inside a drill casing using a collar having multiple angled openings therein for dispersing the incoming air to avoid frictional erosion of the central drill pipe.

It is also an object of the invention to provide air, gas or other fluid introduction collars that are capable of connecting to any oil drilling casing pipe.

It is also an object of the invention to provide air, gas or other fluid introduction collars where air, gas or fluid is injected into the interior of the oil drilling casing pipe at multiple locations.

Additional objects of the invention will be apparent from the detailed descriptions and the claims herein.

DETAILED DESCRIPTION

Figure 3:
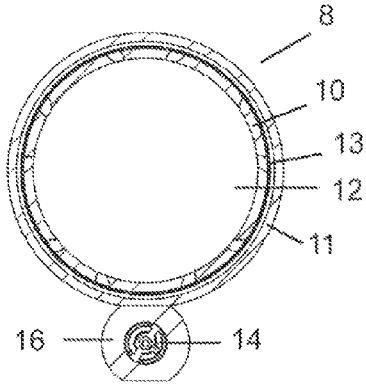
FIG. 3 is a cross sectional top view of the embodiment of FIG. 1 along line II-II.
Figure 1:
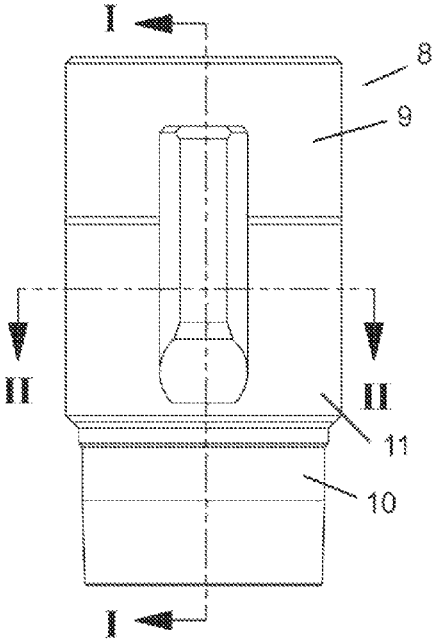
FIG. 1 is a side view of an embodiment of a sleeve of the present invention.
Figure 4:
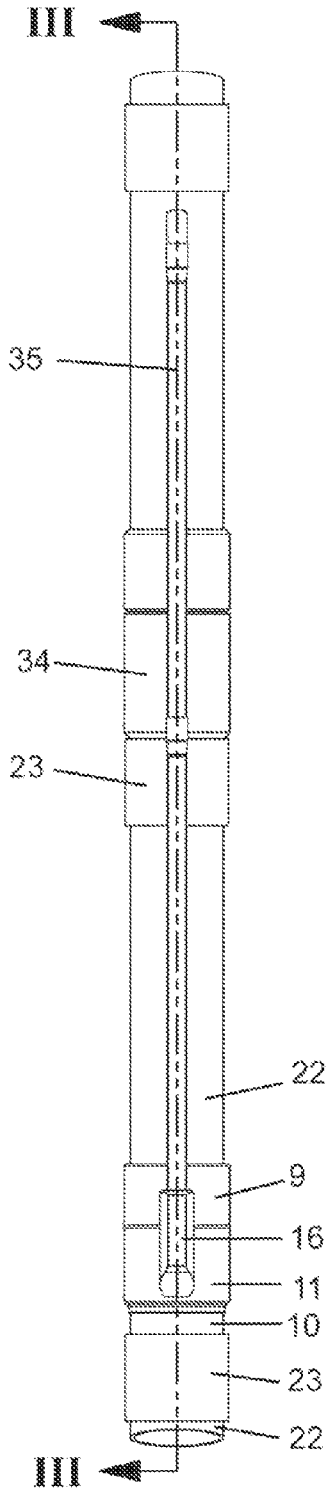
FIG. 4 is a side view of a drill casing in which an embodiment of the present invention has been installed.
Figure 5:
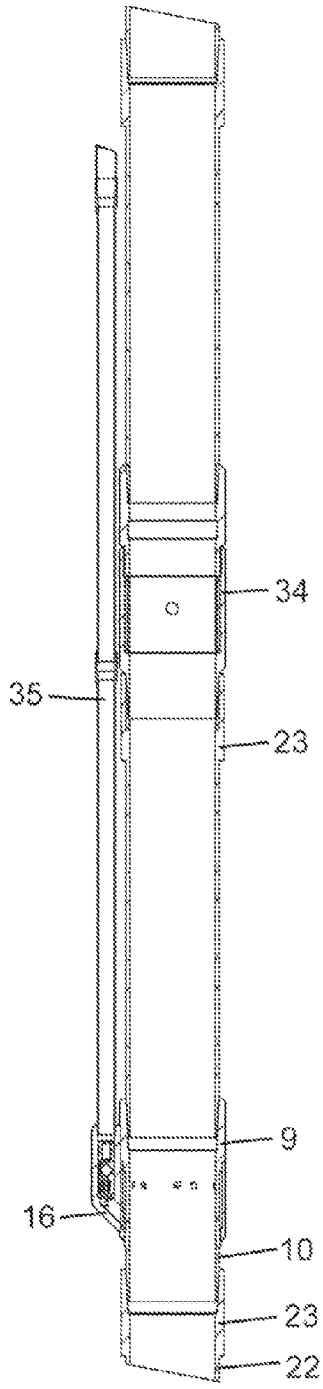
FIG. 5 is cross sectional side view of the embodiment of FIG. 4 along line III-III.

Referring to the drawings wherein like reference characters designate like or corresponding parts throughout the several views, and referring to the illustrated example embodiment of FIGS. 1-6, and particularly to FIGS. 4 and 5, it is seen that the sleeve 8 of the present invention includes a coupling having a first annular wall 9 for engagement with a corresponding wall of a drill casing 22, and a second annular wall 10 for engagement with a corresponding wall of a drill casing coupling 23. The sleeve 8 of the present invention may be coupled to any segment of drill casing located at any depth in a well. In a preferred embodiment, the sleeve 8 is attached to the drill casing at the farthest depth practicable, so as to reduce the weight of the entire column of specialized "mud" above such location. In an alternative embodiment, the annular wall 9 of the sleeve may be engaged to a corresponding wall of a drill casing 22, with the opposite annular wall 10 not being connected to any drill casing wall, but instead forming the base of the drill casing in the well.

The inside diameter of wall 9 in the exemplary embodiment is larger than that of wall 10, such that casing wall 22 fits into wall 9, and wall 10 fits into coupling 23. However, it is to be appreciated that the inside diameters of walls 9 and 10 may be reversed, in which case wall 9 engages coupling 23, and wall 10 engages casing 22. Walls 9 and 10 may be provided with different diameters for use with different sized casings and couplings 22 and 23. In alternative embodiments, walls 9 and 10 may be detachable from each other (rotatably or otherwise), or they may be integrated into a single piece.

Figure 2:
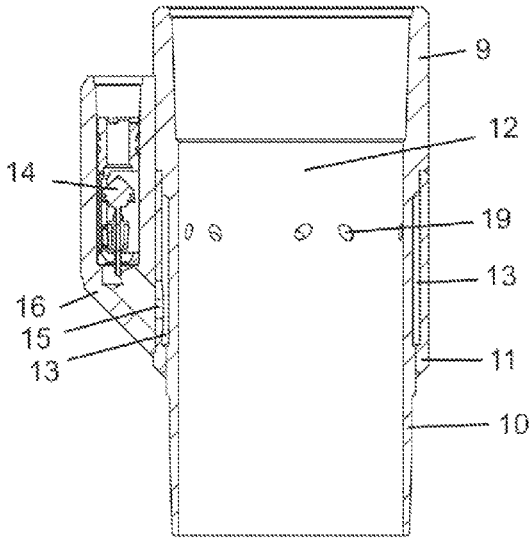
FIG. 2 is a cross sectional side view of the embodiment of FIG. 1 along line I-I.

Referring to FIGS. 2 and 3, it is seen that an outer cylindrical wall 11 is provided around the narrower of cylindrical walls 9 or 10 (wall 10, in the illustrated example) leaving a gap defining an annular air plenum 13 inside between walls 10 and 11. An air or gas pipe 35 extending down from the surface along the outside of the drill casing terminating at outer wall 11 where it is attached to a transitional channel having an inlet 15 in communication with plenum 13. The transitional channel 16 may be integrated into or detachable from outer wall 11. A check valve 14 is provided in the transitional channel 16 to prevent mud or debris from traveling back up pipe 35 when no air pressure is being applied.

A series of openings 19 are provided on the interior of wall 10 leading from plenum 13 to the interior area 12 of the sleeve 8. Openings 19 are provided around the circumference of interior wall 10 in communication with plenum 13, and are offset from inlet 15 so as to avoid direct transmission of pressurized air from inlet 15 through any particular one of openings 19. Plenum 13 preferably has a vertical length that is of sufficient size to allow the inlet 15 and the plurality of openings 19 not to be aligned so as to prevent disproportionate pressure through any of the openings 19. Inlet 15 may be located above or below openings 19 to provide the desired offset. Alternatively, inlet 15 may be located on the same plane as openings 19, so long as none of openings 19 is directly across from inlet 15. Openings 19 may be provided in a regular or irregular pattern around the circumference of wall 10. The openings 19 may be elongated, slotted, curved, etc. and may be narrow or wide, vertical, horizontal or angled, and may be provided in different sizes, shapes and/or patterns.

Figure 11:
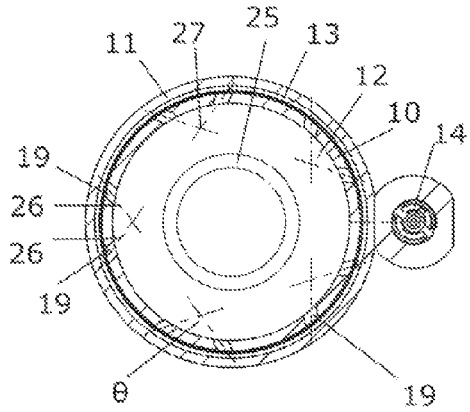
FIG. 11 is a cross sectional top view of the invention along line V-V of FIG. 10 showing exemplary angles for the air or gas openings.

It is preferred that openings 19 be provided in pairs having opposing angles such that the air introduced through the two openings of each pair, intersecting in area 12 in the flow of mud and debris that is away from the central drill pipe 25, so as to avoid causing frictional erosion against pipe 25. Referring to the cross sectional view of FIG. 11, it is seen that openings 19 are provided in pairs, each pair defining two paths 26 that intersect at locations 27, away from the outside edge of drill pipe 25. The angle θ at the intersection 27 of the paths should be between about 80 and about 140 degrees (preferably in the range of about 110 to about 140 degrees) to be closer to wall 10 than to drill pipe 25, and to assure that the intersection does not touch drill pipe 25. The illustrated angles θ in FIG. 11 are approximately 120 degrees. More acute angles may be used in embodiments where there is considerable annular space 12 between wall 10 and pipe 25; more obtuse angles should be used in embodiments where there is less such space. It is to be appreciated that different angles may be used with different pairs of openings on the same collar. Openings 19 may alternatively be provided in cooperating sets of three, four, or more, or different groupings thereof.

Figure 12:
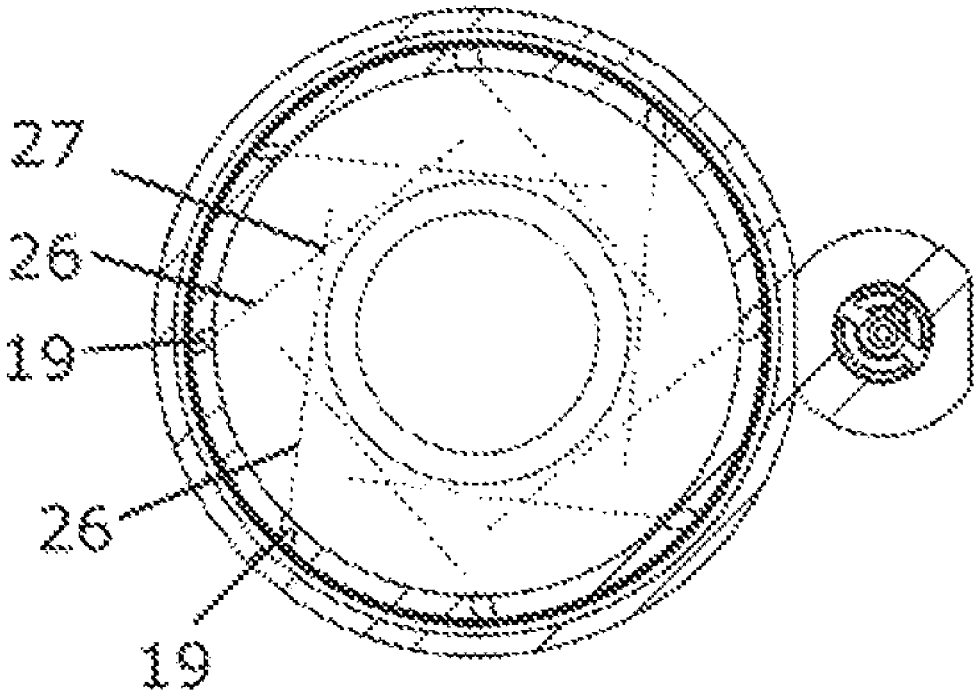
FIG. 12 is a cross sectional top view of the invention along line V-V of FIG. 10 showing other exemplary angles for the air or gas openings.

In an alternative embodiment, and as shown in FIG. 12, openings 19 may all be angled in the same horizontal direction, thereby causing a circular flow of air and fluid around the drill pipe 25. In another embodiment, the openings may be angled in a vertical direction to prevent direct injection of air towards the drill pipe. In yet another embodiment, openings 19 may be angled both horizontally for circular flow, and vertically for upward or downward helical flow around drill pipe 25.

Figure 6:
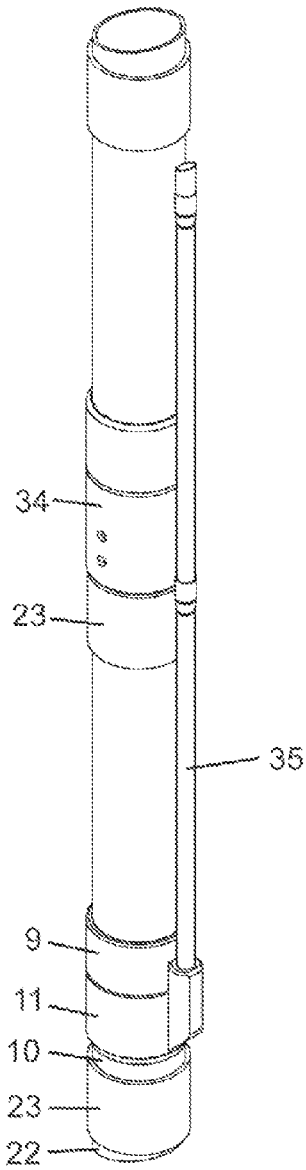
FIG. 6 is a perspective view of the embodiment of FIG. 4.
Figure 7:
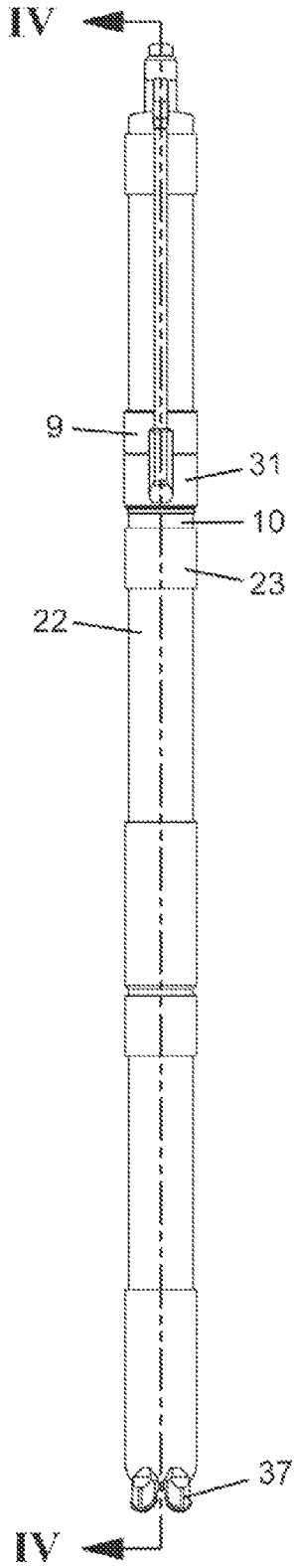
FIG. 7 is a side view of a drill casing in which an embodiment of the present invention has been installed.
Figure 8:
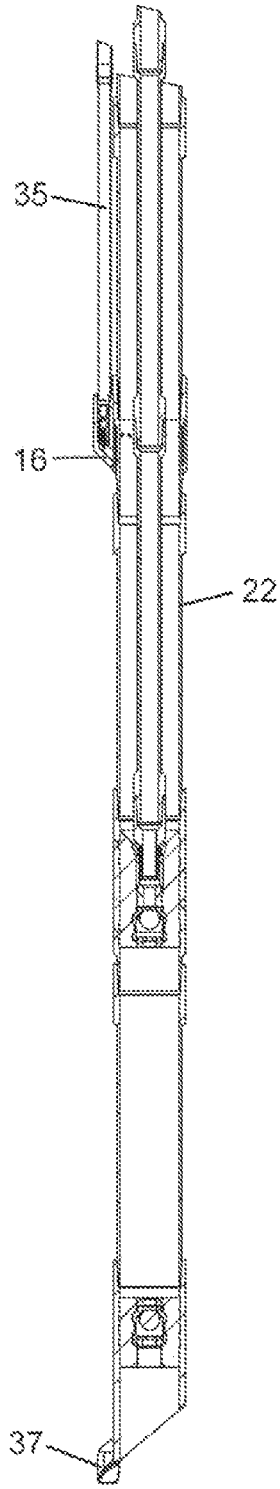
FIG. 8 is cross sectional side view of the embodiment of FIG. 7 along line IV-IV.
Figure 9:
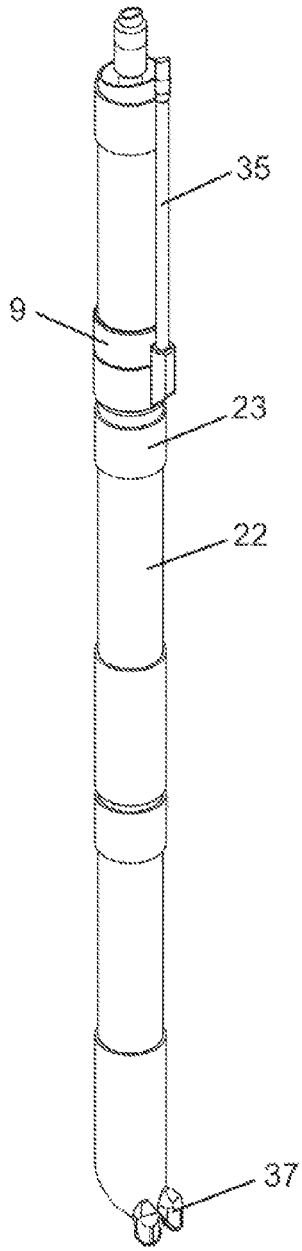
FIG. 9 is a perspective view of the embodiment of FIG. 7.
Figure 10:
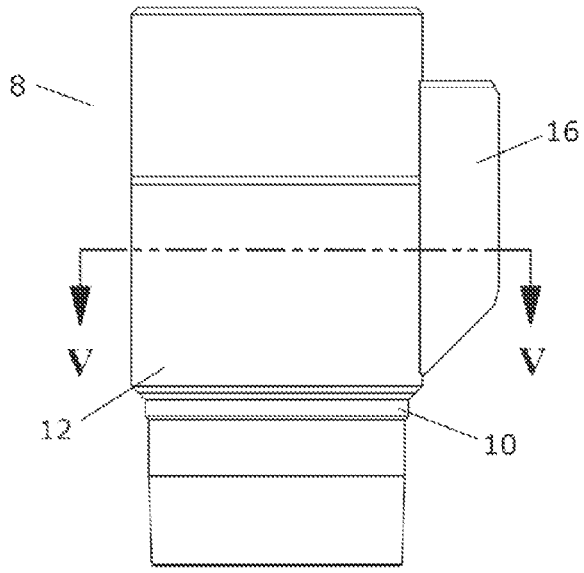
FIG. 10 is a side view of the embodiment of FIG. 1 rotated 90° from the view of FIG. 1.

FIGS. 4 through 6 illustrate an exemplary placement of an air injection collar of the present invention with respect to a particular drill casing. As shown, segments of drill casing 22 are vertically connected to rotating stage collars 34 to create a column of casing of great length. Sections of drill casing are connected by securing the casing segments 22 to a rotating stage collar 34 by means of a drill casing coupling 23. The air injection collar may be attached to a section of casing 22 in the same manner as the rotating stage collar 34. An exterior air, gas or other fluid transmission pipe 35 attaches to the transitional section 16 of collar 8 and follows the path of the drill casing vertically to the surface of the well. FIGS. 2 and 5 provide cross-sectional views of an exemplary casing pipe and air injector collar of the present invention. Interior drill pipe 25 is not shown in FIG. 2 or 5 to better illustrate the path through which the air, gas or other fluid flows. (Drill pipe 25 is shown in FIGS. 7-9.). The air flows down from the surface through air transmission pipe 35 to the transitional section 16, around stop valve 14 (that is pushed open by the pressure of the incoming air), through the inlet 15 into the plenum 13. The air pressure equalizes inside plenum 13, and is expelled evenly into the interior area 12 through the plurality of openings 19. From there, the air mixes with the upflowing column of mud and debris creating a lighter mixture from that point upward, reducing the overall weight of the column.

In use, the collar 8 of the present invention is attached to a drill casing segment 22, and inserted into the drill hole. Pipes 35 are inserted into the hole along with drill casing segments 22 until the desired location for the collar is reached. Drilling operations then occur, with drill pipe 25 extending down the center of casing 22. Mud is pumped downward inside pipe 25 until it reaches the drill bit where it mixes with debris that has been dislodged. The mud and debris mixture then returns to the surface in the annular area 12 inside the casing around the outside of pipe 25. Air, gas or other fluid is pumped down pipe 35 to transition area 16, through inlet 15 and into plenum 13 of the collar 8. This air escapes into the annular area 12 through the plurality of openings which are positioned to prevent frictional erosion against pipe 25. The air mixes with the mud and debris, reducing the weight of the column inside annular area 12, improving drilling efficiency. If the air is shut off, stop valve 14 prevents mud and debris from traveling upward through pipe 35.

It is to be understood that variations and modifications of the present invention may be made without departing from the scope thereof. It is also to be understood that the present invention is not to be limited by the specific embodiments, components or parts disclosed herein, nor by any of the exemplary dimensions set forth in the attached illustrations.

What is claimed is:

1. A fluid delivery apparatus for a drilling system, said apparatus comprising:

a first cylindrical wall defining a hollow interior, said hollow interior configured so as to receive a drill pipe extending therethrough;

a second cylindrical wall provided around said first cylindrical wall;

an annular space formed between a surface of said first cylindrical wall and a surface of said second cylindrical wall, wherein said surface of said first cylindrical wall and said surface of said second cylindrical wall are about parallel;

a fluid inlet in said second cylindrical wall in communication with said annular space;

a transitional channel attached to the exterior of said second cylindrical wall that is not concentric with said second cylindrical wall, said transitional channel being in fluid communication with said fluid inlet; and a plurality of openings in said surface of said first cylindrical wall between said annular space and said hollow interior.

2. The apparatus of claim 1 further comprising a one-way valve provided in said transitional channel near said fluid inlet.

3. The apparatus of claim 1 further comprising a stop valve provided in said transitional channel near said fluid inlet.

4. The apparatus of claim 1 wherein said fluid inlet is not directly adjacent to any one of said plurality of openings.

5. The apparatus of claim 1 wherein said transitional channel comprises a port which is not concentric with said second wall and which is in fluid communication with said fluid inlet.

6. A fluid delivery apparatus for a drilling system comprising:

a first wall with a hollow interior configured to receive a drill pipe extending therethrough;

a second wall provided around said first wall, wherein an outside surface of said first wall and an inside surface of said second wall are about parallel and form a space therebetween;

a fluid inlet in said second wall in communication with said space;

a transitional channel engaged with an outside surface of said second wall, wherein said transitional channel is not concentric with said second wall and is in fluid communication with said fluid inlet; and at least one opening in said outside surface of said first wall communicating between said space and said hollow interior.

7. The apparatus of claim 6 further comprising a plurality of openings in said outside surface of said first wall.

8. The apparatus of claim 7 wherein said fluid inlet is offset from said plurality of openings.

9. The apparatus of claim 7 wherein said fluid inlet is not directly adjacent to any one of said plurality of openings.

10. The apparatus of claim 7 wherein said transitional channel comprises a port which is not concentric with said second wall and which is in fluid communication with said fluid inlet.

11. The apparatus of claim 6 further comprising a one-way valve provided in said transitional channel near said fluid inlet.

12. The apparatus of claim 6 wherein said transitional channel comprises a port which is not concentric with said second wall and which is in fluid communication with said fluid inlet.

13. The apparatus of claim 6, wherein said first wall and said second wall are about cylindrical.

14. A method for mixing a fluid with mud and debris flowing upward on the inside of a drill casing comprising a step of introducing said fluid under pressure into a space provided within a sleeve, said space being defined by (i) a surface of an inner wall of said sleeve having at least one opening therein communicating between said space and an interior region, and (ii) a surface of an outer wall of said sleeve having an inlet therein communicating between a fluid source and said space through a non-concentric exterior transitional channel, wherein said surface of said inner wall and said surface of said outer wall are about parallel, wherein a drill pipe extends through said interior region and wherein said sleeve is engaged with said drill casing.

15. The method of claim 14, further comprising the step of disposing said sleeve between a first drill casing section and a second drill casing section.

16. The method of claim 14, further comprising the step of preventing direct transmission of fluid between said inlet and said at least one opening.

17. The apparatus of claim 14, wherein said inner wall and said outer wall are about cylindrical.

18. A fluid delivery apparatus comprising:

a first cylindrical wall with a central axis and a hollow interior for receiving a drill pipe, said first cylindrical wall having a surface that is about parallel to said central axis;

a second cylindrical wall around said first cylindrical wall, said second cylindrical wall having a surface;

an annular space bound by said surface of said first cylindrical wall and said surface of said second cylindrical wall;

a fluid inlet in said surface of said second cylindrical wall in communication with said annular space;

a transitional channel in communication with said fluid inlet, wherein said transitional channel has a central axis that is not along said central axis of said first cylindrical wall; and at least one opening in said surface of said first cylindrical wall in communication with said annular space.

19. The apparatus of claim 18, wherein said at least one opening is not directly adjacent to said fluid inlet.

20. The apparatus of claim 19, further comprising a plurality of openings in said surface of said first cylindrical wall in communication with said annular space.

21. The apparatus of claim 18, wherein said surface of said second cylindrical wall is about parallel to said central axis.

22. An apparatus for injecting fluid in a drill casing comprising:

an inner cylindrical wall having an about constant diameter with a hollow interior for receiving a drill pipe;

an outer cylindrical wall around said inner cylindrical wall;

an annular space between about parallel surfaces of said outer and said inner cylindrical walls;

a fluid inlet in said surface of said outer cylindrical wall in communication with said annular space and a transitional channel, wherein said transitional channel is not concentric with said outer cylindrical wall; and a plurality of openings in said surface of said inner cylindrical wall in communication with said annual space and said hollow interior, wherein said plurality of openings are not directly adjacent said fluid inlet.

23. A fluid delivery apparatus for attachment between a first drill casing section and a second drill casing section, said apparatus comprising:

a cylindrical collar having a hollow interior for receiving a drill pipe, said collar having an annular space formed between an inside wall of said collar and an outside wall of said collar;

a transitional channel that is not concentric with said collar;

a fluid inlet in a surface of said outside wall of said collar in communication with said annular space and said transitional channel; and a plurality of openings in a surface of said inside wall of said collar in communication with said annular space and said hollow interior.

24. The apparatus of claim 23, wherein said surfaces of said inside and outside walls of said collar forming said annular space are about parallel.

25. The apparatus of claim 23, wherein said surface of said inside wall of said collar is about parallel to a central axis of said collar.

26. The apparatus of claim 25, wherein said surface of said outside wall of said collar is about parallel to a central axis of said collar.

* * * * *